United States Patent [19]

Fergg et al.

[11] 4,169,672

[45] Oct. 2, 1979

[54] METHOD AND APPARATUS FOR PHOTOELECTROPHORETIC-COLOR-PROCESS COPYING

[75] Inventors: Berthold Fergg, Taufkirchen; Wolfgang Zahn, Munich, both of Fed. Rep. of Germany

[73] Assignee: AGFA-Gevaert, A.G., Leverkusen, Fed. Rep. of Germany

[21] Appl. No.: 858,165

[22] Filed: Dec. 7, 1977

[30] Foreign Application Priority Data

Dec. 14, 1976 [DE] Fed. Rep. of Germany ..... 2656657

[51] Int. Cl.[2] ..... G03G 15/00

[52] U.S. Cl. ..... 355/3 P; 96/1 PE; 355/16

[58] Field of Search ..... 355/3 R, 3 P, 16; 96/1 PE; 204/299 P, 300 P

[56] References Cited

U.S. PATENT DOCUMENTS

| | | | |
|---|---|---|---|
| 3,761,174 | 9/1973 | Davidson | 355/16 |
| 3,945,724 | 3/1976 | Jackson | 355/3 P |
| 3,986,772 | 10/1976 | Hermanson | 355/3 P |
| 3,989,366 | 11/1976 | Teumer et al. | 355/3 P |

*Primary Examiner*—Fred L. Braun

*Attorney, Agent, or Firm*—Michael J. Striker

[57] ABSTRACT

A first and second electrode web, of which at least one is transparent, are transported along respective paths both passing through an exposure station. A toner applicator upstream of the exposure station applies to the first web a uniform layer of toner suspension. Upstream of the exposure station, the coated first web and the second web are sandwiched to form a sandwiched film pack in which the toner suspension layer is located intermediate the two webs. The transport of at least that section of the webs constituting the sandwiched film pack at the exposure station is intermittent, but nevertheless the relative movement between the toner applicator and the first web is maintained uninterruptedly unidirectional and of uninterruptedly constant speed. At the exposure station, a color toner image is formed, on a whole-image basis, by projecting the whole image to be copied onto the toner suspension layer of the film pack section through the transparent web thereof while such section is at a standstill at the exposure station, and a corresponding color toner image is produced photoelectrophoretically. Downstream of the exposure station, the color toner image is transferred onto copy material.

6 Claims, 4 Drawing Figures

METHOD AND APPARATUS FOR PHOTOELECTROPHORETIC-COLOR-PROCESS COPYING

BACKGROUND OF THE INVENTION

The present invention relates to the copying of originals using a photoelectrophoretic color process. A first and a second electrode web are transported from respective supply units to respective take-up units along a predetermined path. At least one of the electrode webs is transparent. During operation, one of the electrode webs continuously receives a coating of toner suspension at a coating station. Downstream of the coating station, the two electrode webs are combined to form a sandwiched film pack, between the constituent electrode webs of which the toner-suspension layer is confined. This film pack is exposed at an exposure station, and a toner image is photoelectrophoretically formed within the film pack. The toner image is then transferred onto a web of copy material, i.e., onto the material on which the final copy is to be formed.

With one known arrangement of this type, the electrode web material is continuously (non-intermittently) transported through the apparatus. It is exposed at an exposure station located in the vicinity of two guide rollers operative for combining the two electrode webs into the aforementioned sandwiched film pack. To this end, one of the two guide rollers is made of transparent material. The exposure per se is accomplished utilizing a deflecting mirror mounted on the structure of the apparatus but located within the transparent guide roller. The deflecting mirror deflects exposure radiation through the transparent material of the transparent one of the guide rollers onto the portion of the sandwiched film pack which is located between the two guide rollers. Downstream of these two guide rollers, the two electrode webs are pulled apart from one another, so that the toner image formed on one of the two electrode webs can be transferred to the final copy material.

Due to the curvature of the guide rollers, the part of the film pack therebetween actually exposed at any given moment is a very narrow transverse strip extending parallel to the guide roller axes. Accordingly, the system becomes of the type wherein successive transverse strip-shaped zones of the original are scanned, and successive transverse strip-shaped zones of the intermediate toner image are formed successively, i.e., in synchronism with the scanning of the original.

This involves many disadvantages, some of them specific to the fact that a photoelectrophoretic color process is involved. The relative movements involved in scanning the original and in transporting the film pack through the exposure station must be synchronized, involving cost for accurate synchronizing means. Furthermore, if the originals to be copied are for example film negatives, expensive equipment becomes necessary for regulation of image color and density; because the total exposure time for each successive transverse strip-shaped zone of the film pack is quite short, it is necessary to measure and evaluate each transverse strip of the original with respect to color and density prior to exposing the corresponding strip-shaped zone of the film pack, to assure that the exposure conditions are properly varied if for example an extreme of color or density is to be produced during the short-lasting exposure of one strip-shaped zone.

One reason for resorting to the inconvenience and complexity of a strip-by-strip exposure technique relates to the application of the toner-suspension layer to one of the electrode webs of the film pack. It is important that the toner-suspension coating be applied to the electrode web in question with perfect uniformity, to assure that the thickness of the applied layer be perfectly constant. As a practical matter, to ensure that this occurs, it is generally considered necessary that the electrode web receiving the toner layer be moved past the toner applicator at very constant speed and continuously (non-intermittently). For this reason non-intermittent transport of the web receiving the toner-suspension coating tends to dictate that the entire system operate non-intermittently, resulting in the type of strip-by-strip exposure technique in question.

Aside from the already mentioned synchronization and exposure-control problems inherent in such strip-by-strip exposure methods, there is also the disadvantage that the continuous (completely non-intermittent) transport of electrode web material stands in the way of optimal utilization of web material. For example, as the original just copied is moved out from the copying station and the next original moved in, the web material transported during this time interval will in general be wasted. The shorter the required exposure time (i.e., the higher the transport speed of the web material) relative to the time required for the changeover from one original to the next, the greater becomes the waste of electrode web material and toner suspension.

SUMMARY OF THE INVENTION

It is a general object of the invention to provide a system of the type in question—i.e., wherein an electrode web is continuously coated with toner suspension and a sandwiched film pack is formed for exposure—but of such a character as to avoid the disadvantages just discussed.

More specifically, it is an object of the invention to be able to intermittently transport the film pack, at least in the vicinity of the exposure station, so that the exposure can be performed on a whole-image basis, not on the basis of successively scanned strip-shaped zones, while yet avoiding all affects which might detract from the uniformity of application of the toner-suspension coating.

Still more specifically, it is a concept of the invention to maintain constant the direction and speed of relative movement between the toner applicator and the toner-receiving web, and to maintain such relative movement non-intermittent, despite the intermittent transport of the film pack at the exposure station.

This concept makes possible maximal utilization of materials consumed in the copying process, i.e., the electrode web material and toner suspension, without imposing restraints upon the freedom with which one may select and implement the requisite or desired exposure duration or implement exposure-control variation for problematic color or density situations.

In one embodiment of the invention, the toner applicator is stationary and, in the region of the toner applicator, the toner-receiving electrode web is moved completely non-intermittently, at constant speed. In contrast, in the region of the exposure station, the resultant film pack is transported intermittently, once per exposure operation. To compensate for the intermittent and non-intermittent transport of the film pack and of its constituent toner-receiving web, an equalizer in the form of a web loop accumulator, is located intermediate the toner applicator station and the exposure station.

In another embodiment of the invention, the constituent electrode webs of the film pack are transported intermittently, not only in the region of the exposure station, but upstream and downstream thereof as well, including corresponding intermittent transport of the toner-receiving web at the toner applicator station. However, at the toner applicator station, the toner applicator is mounted for movement along the direction of transport of the toner-receiving web. The toner-receiving web moves intermittently at the toner applicator station, in a single direction. The toner applicator moves back and forth along the toner-receiving web. The direction reversals of the toner applicator and its speeds of movement are controlled in dependence upon the speed of web transport and the relative durations of web transport and web standstill. This coordination is implemented in dependence upon the intermittent transport mechanism for the toner-receiving web, using either closed-loop (negative-feedback) or open-loop control. Although the web transport at the toner applicator station is intermittent, and although the toner applicator reciprocates and travels with different respective speeds during its forward and return strokes, the relative movement between the toner applicator and the toner-receiving web is maintained both unidirectional and of constant speed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
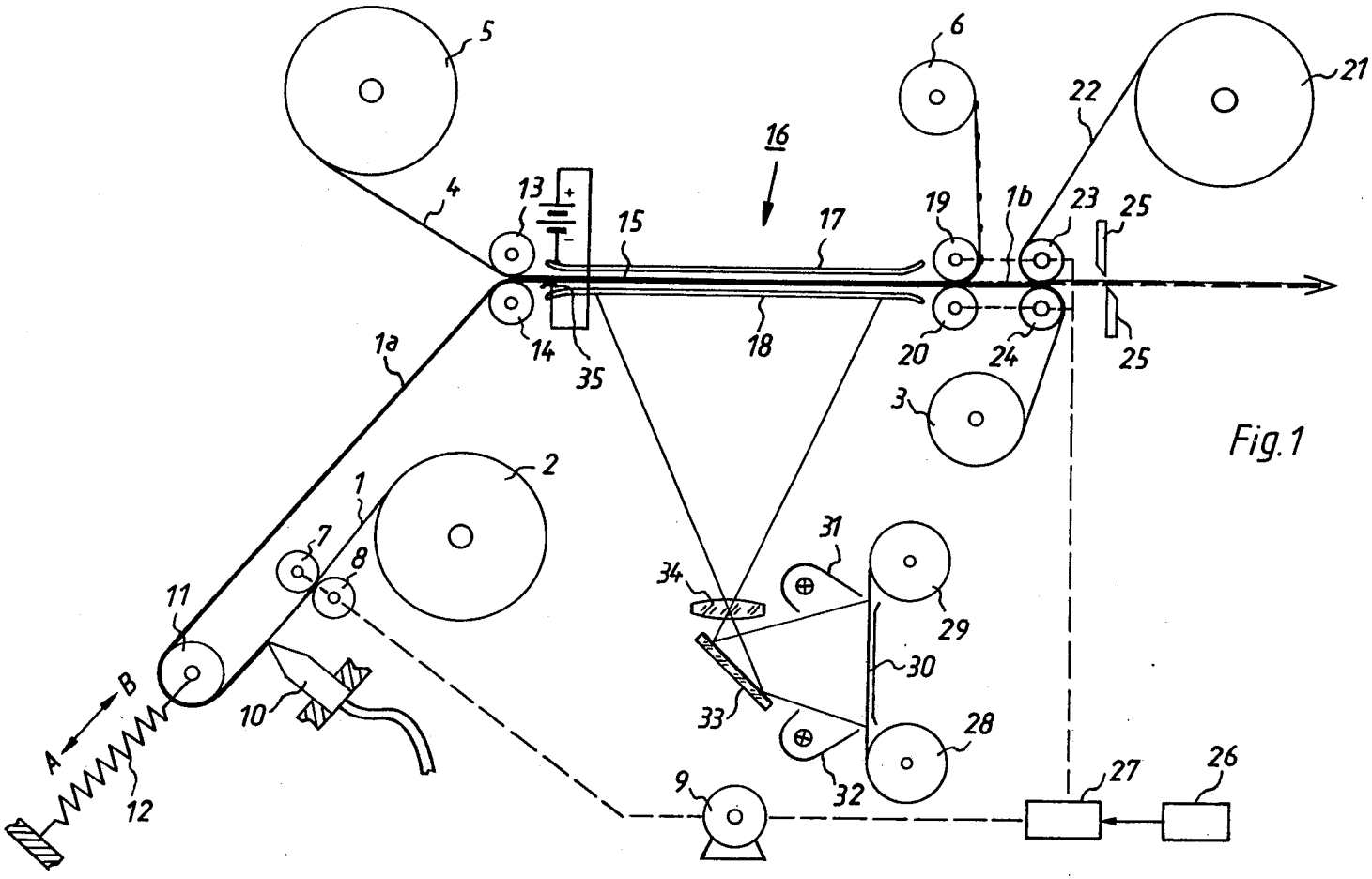
FIG. 1 depicts one embodiment of the invention, utilizing a loop-accumulator equalizer.

In the embodiment of FIG. 1, a transparent electrode web 1, constituting the so-called injecting electrode, is transported from a supply roll 2 to a take-up roll 3. A further electrode web 4, constituting the so-called blocking electrode, is transported from a supply roll 5 to a take-up roll 6. A copy-material web 22 is pulled off a supply roll 21, for transfer of an intermediate color toner image thereto. The supply rolls 2, 5 and 21 are passive, and offer a certain amount of frictional resistance to web pull-off. The take-up rolls 6 and 3 are driven rollers. Web tension is limited, in per se conventional manner, by incorporating slip clutches between the take-up rolls 6 and 3 and their drives.

Electrode web 1 is pulled off supply roll 2 by a driven transport roller pair 7, 8, driven by a motor 9. The roller pair 7, 8 operates at constant speed. A toner applicator 10 applies to the electrode web 1 a thin and very uniform layer of toner suspension 1*a*. Downstream of the toner applicator 10, the electrode web 1 travels around a guide roller 11. Guide roller 11 is movably mounted in the direction of arrow A–B, and is pulled in direction A by a tension spring 12. A passive roller pair 13, 14 continually sandwiches the electrode webs 1, 4 to form a sandwiched film pack 15, i.e., in which the toner-suspension layer 1*a* is confined between the webs 1 and 4.

The film pack 15 is transported through the exposure station 16 between two guide plates 17, 18 of which guide plate 18 is transparent. Intermittent transport of the film pack 15 through the exposure station 16 is effected by an intermittently operative driven transport roller pair 19, 20 located downstream of the exposure station 16. Just downstream of roller pair 19, 20, the electrode web 4 is pulled off the electrode web 1, guided around transport roller 19, and collected on take-up roll 6.

The copy-material web 22 is pulled off its supply roll 21 and guided, together with the toner-image-bearing injecting-electrode web 1, between the rollers of a transport roller pair 23, 24. Roller pair 23, 24 and roller pair 19, 20 are synchronously driven by motor 9, through the intermediary of an intermittently activated magnetic coupling 27, the intermittent energization of which is controlled by a timer 26. A severing unit 25, 25 is located downstream of roller pair 23, 24, for severing successive sections of the copy-material web 22.

A strip of originals 30 to be copied is intermittently transported, one original at a time, from a supply roll 28 to a take-up roll 29. Each successive original 30, while stationary in the copying position, is illuminated by light sources 31, 32 and its image projected, by means of a deflecting mirror 33 and an objective 34, through the transparent guide plate 18 onto the stationary film pack section 15 at the exposure station 16, on a whole-image basis.

At the exposure station 16, the upper guide plate 17 is connected to negative potential. A transverse charging bar 35 located beneath the electrode web 1 just downstream of the roller pair 13, 14 is connected to positive potential. The color toner particles in the toner-suspension layer 1*a* are initially of negative charge. Accordingly, as the sandwich 4, 1*a*, 1 travels over the positive-potential charging bar 35, the negatively charged color toner particles are attracted to the injecting electrode web 1. When the image of the original to be copied is then projected onto the toner-suspension layer at the exposure station 16, the toner-suspension layer becomes electrically conductive, and in dependence upon the received light image the color toner particles become recharged and are attracted to the negatively charged blocking electrode web 4. The color toner particles remaining on the injecting electrode web 1 then constitute a positive color image 1*b*. Then, downstream of the exposure station 16, the roller pair 23, 24 transfers this positive color toner image 1*b* to the actual copy material 22, by heat and pressure action. If desired, the successively formed copies on the copy material web 22 are severed by the severing unit 25, 25.

During the exposure operation, the transport rollers 19, 20 and 23, 24 are decoupled from the drive motor 9, so that the film pack 15 at the exposure station 16 will be at a standstill. In contrast, there is no interruption in the constant-speed operation of the transport roller pair 7, 8 which pulls the electrode web 1 from the supply roll 2. The excess feed of web 1 during the exposure operation is equalized by accumulation of web at the loop-accumulator equalizer 11, 12. Thus, there is no interruption of the constant-speed transport of the web 1 past the toner applicator 10, and the application of a very uniform toner-suspension coating is assured. After the exposure operation has been performed, the timer 26 reactivates the magnetic coupling 27, the transport roller pairs 19, 20 and 23, 24 are recoupled to drive motor 9, and film-pack transport is resumed. Upon resumption of film-pack transport, the size of the web loop accumulated by equalizer 11, 12 decreases back to its original value.

Figure 2:
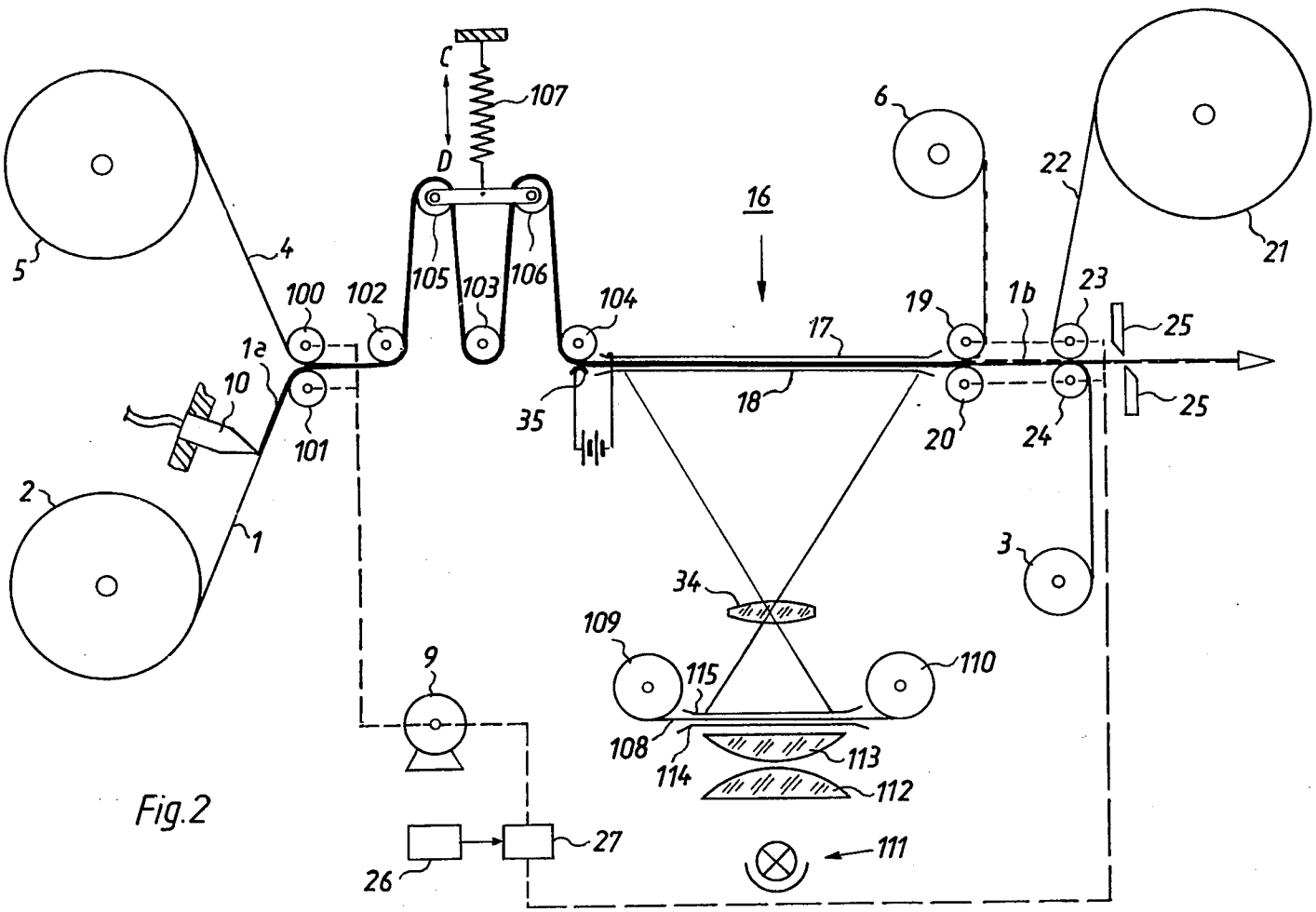
FIG. 2 depicts a second embodiment, utilizing a different and differently located loop-accumulator equalizer.

The embodiment of FIG. 2 is similar to that of FIG. 1, and corresponding structure is denoted by corresponding reference numerals. However, in FIG. 2, the loop-accumulator equalizer is located downstream of the filmpack forming roller pair 100, 101, and is operative for accumulating film pack instead of constituent web. The equalizer includes stationary guide rollers 102–104 and shifting guide rollers 105, 106 mounted on a shiftable bracket shiftable in the direction of arrow C–D and biased by a tension spring 107 which exerts pull in direction C. The transport roller pair 100, 101 is continuously (non-intermittently) driven by motor 9, whereas the roller pairs 19, 20 and 23, 24 are intermittently driven in the manner described with respect to FIG. 1.

A transparent film strip 108, the constituent originals of which are to be copied, is intermittently transported, one original at a time, from a supply roll 109 to a take-up roll 110. Each original is illuminated by a light source 111 through the intermediary of condenser lenses 112, 113, and its image projected onto the toner-suspension layer at the exposure station 16. Numerals 114, 115 denote transparent guide plates.

Figures 3, 4:
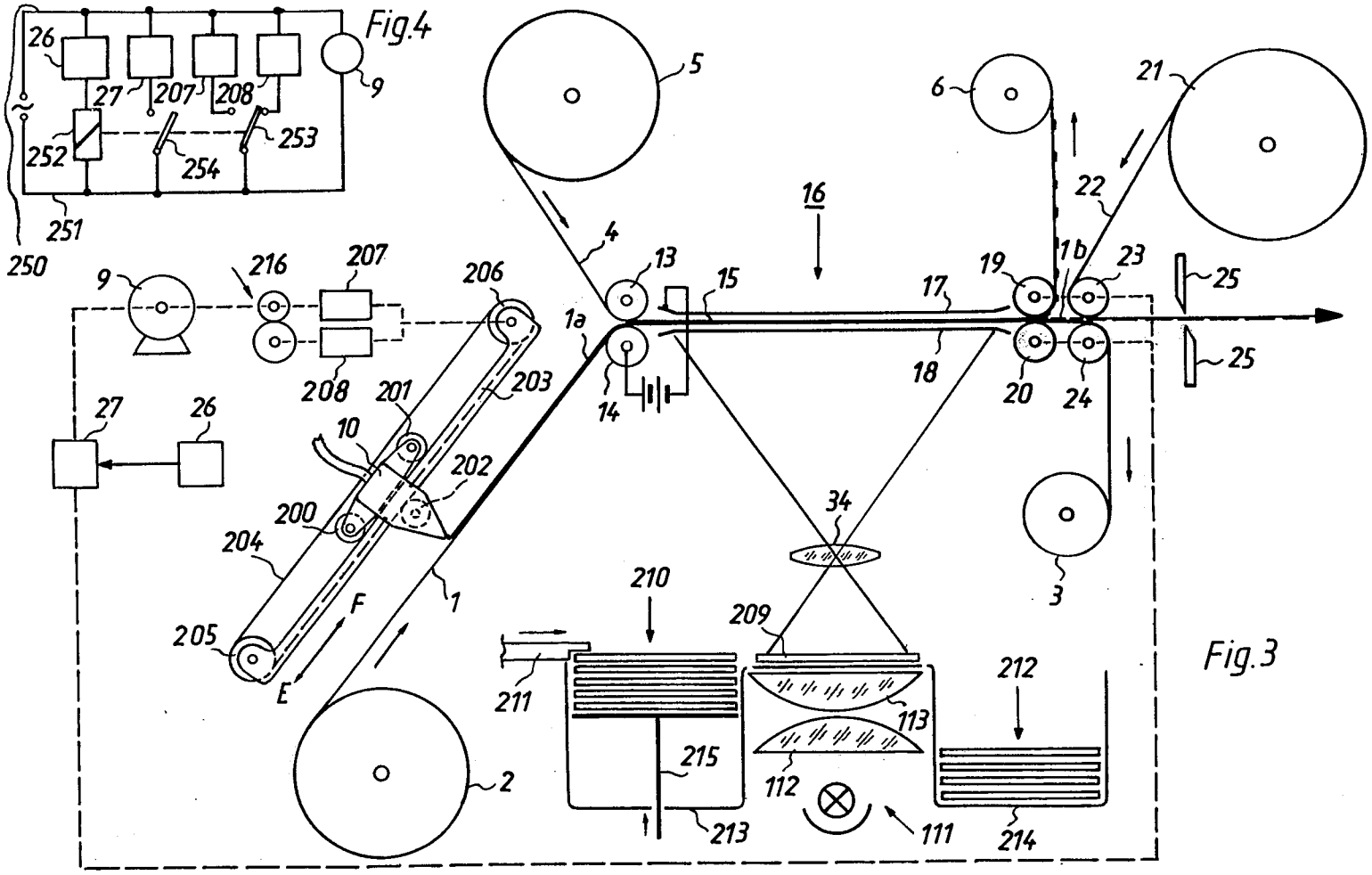
FIG. 3 depicts a third embodiment, utilizing a reciprocating toner applicator.
FIG. 4 depicts a control circuit which can be used to correlate the movements performed in the embodiment of FIG. 3.

In the embodiment of FIG. 3, structure corresponding to that in FIGS. 1 and 2 is denoted by corresponding reference numerals. The embodiment of FIG. 3 does not make use of a loop-accumulator equalizer. Instead, the toner applicator 10 is mounted for movement along the length of the electrode web 1. The electrode web 1 is transported intermittently in the region of the toner applicator 10, and the toner applicator 10 travels back and forth along this section of the electrode web 1. The back and forth travel of the toner applicator, and the respective speeds at which it performs its forward and return movements, are so controlled that, despite the intermittent transport of web 1, and despite the back and forth travel of toner applicator 10, the relative movement between toner applicator 10 and web 1 is uninterruptedly unidirectional and of uninterruptedly constant speed.

The toner applicator 10 is provided with wheels 200–202 and rides on a guide rail 203 which extends parallel to the adjoining stretch of electrode web 1. A tension wire 204, the two ends of which are each secured to the toner applicator 10, is trained around guide rollers 205, 206 mounted on the guide rail 203. Guide roller 206 is driven by motor 9, through the intermediary of a transmission 216. The transmission includes two electrically controlled couplings 207, 208, one for forward travel of applicator 10, the other for return travel of applicator 10. I.e., the two couplings 207, 208 are activated alternately, to implement back and forth travel of applicator 10. If the speeds of forward and return travel of applicator 10 are to differ, this can be implemented by having the couplings 207, 208 connected within different respective transmission-ratio-paths of the transmission 216.

The forward and reverse travel speeds of toner applicator 10 are so selected that, for travel in direction F the forward-travel speed $V_1 = V_v \cdot T_v/(T_s + T_v)$, and for reverse travel in direction E the reverse-travel speed $V_2 = V_v \cdot T_s(T_s + T_v)$. $V_v$ is the speed of the intermittently transported web material, when the web material is in motion. $T_v$ is the length of the time interval during which the intermittently transported web material is in motion, per transport step. $T_s$ is the length of the time interval during which the intermittently transported web material is at a standstill, per transport step.

FIG. 4 depicts an exemplary circuit for coordinating the intermittent transport of the electrode web material and the back and forth travel of the toner applicator 10. The drive motor 9 is connected between supply lines 250, 251. The electromagnet couplings 207, 208 and 27 and also a relay winding 252 are connected in parallel thereto. The timer 26 is connected in series with the relay winding 252. The relay winding 252 controls relay contacts 253, 254 connected as shown. Timer 26 energizes and deenergizes relay winding 252 once per operating cycle. When the relay contacts 253, 254 are in their illustrated settings, coupling 27 is deactuated, and the web material at exposure station 16 is at a standstill; the coupling 208, however, is activated, and the toner applicator 10 travels in direction E at a predetermined speed. When relay contacts 253, 254 assume their other settings, coupling 27 is actuated, and web transport at the exposure station 16 occurs; also, the coupling 207 is actuated, and the toner applicator 10 travels in direction F at a predetermined speed.

In the embodiment of FIG. 3, the originals to be copied consist of discrete sheets of transparent film material 209, e.g., diapositives. The individual diapositives are moved by a transport device 211, one by one, from a supply stack 210 through copying station 111–113 and then onto a discharge stack 212. Each original is kept at a standstill at the copying station, for performance of the exposure operation. Numerals 213 and 214 denote holding bins for the supply and discharge stacks, and numeral 215 an elevator for raising the supply stack 210 to keep the level of the uppermost original constant.

While FIG. 4 depicts a purely open-loop control system with interlocks (i.e., having no negative-feedback action), use could alternatively be made of a closed-loop (negative-feedback) control system. For example, one of the transport rollers 13, 14, 19, 20, 23 or 24 could be provided with a tachogenerator, operative for generating a first analog signal indicative of instantaneous web transport speed. A separate and reversible drive motor would be utilized for the toner applicator 10 and would be provided with a tachogenerator operative for generating a second analog signal indicative of the direction and instantaneous speed of toner-applicator travel. The first and second analog signals would be continually compared, to yield a difference signal indicative of the direction and speed of relative movement between the web material and the toner applicator. This difference signal would be continually compared against a desired speed and direction signal, to yield an error signal used to control the speed and direction of operation of the drive motor for toner applicator 10. In this way, the relative movement between the toner applicator 10 and the adjoining stretch of web material would be kept uninterruptedly unidirectional and of uninterruptedly constant speed, by negative-feedback action.

It will be understood that each of the elements described above, or two or more together, may also find a useful application in other types of circuits and constructions differing from the types described above.

While the invention has been illustrated and described as embodied in a particular type of photoelectrophoretic copying, it is not intended to be limited to the details shown, since various modifications and structural changes made be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a photoelectrophoretic-color-process copying machine, in combination, an exposure station; guiding means for guiding a first and a second electrode web, of which at least one is transparent, along respective transport paths both of which pass through the exposure station; toner-applying means located along the first web transport path upstream of the exposure station operative for applying to the first web a uniform layer of toner suspension; sandwiching means located along the first and second web transport paths upstream of the exposure station and downstream of the toner-applying means, operative for combining the coated first web and the second web into a sandwiched film pack in which the toner-suspension layer is confined between the first and second webs; transport means operative for transporting the webs along their respective paths, effecting intermittent transport of at least that section of the webs constituting the sandwiched film pack located at the exposure station, and despite said intermittent transport maintaining the relative movement between the toner-applying means and the first web unidirectional and of constant speed; means at the exposure station operative for projecting the whole image to be copied onto the toner suspension layer of a film pack section through the transparent web thereof while such section is at a standstill at the exposure station, and photoelectrophoretically producing a corresponding color toner image; and transfer means downstream of the exposure station operative for transferring the color toner image onto copy material.

2. In a copying machine as defined in claim 1, the transport means comprising means operative for effecting non-intermittent constant-speed transport of the first web past the toner-applying means and loop-accumulator equalizing means located downstream of the toner-applying means and upstream of the exposure station operative for compensating for the difference between the non-intermittent transport of the first web part the toner-applying means and the intermittent transport of the first web through the exposure station by forming in the first web an equalizing loop of alternatively increasing and decreasing length.

3. In a copying machine as defined in claim 1, the toner-applying means being mounted for movement along a section of the first web transport path located upstream of the sandwiching means, the transport means comprising means operative for effecting intermittent transport of the first web not only through the exposure station but also upstream thereof in the region of the toner-applying means and means operative during the intermittent transport of the first web for moving the toner-applying means back and forth along the first web with direction reversals and forward and reverse speeds such as to keep the relative movement between the toner-applying means and the first web unidirectional and of constant speed.

4. In a copying machine as defined in claim 3, the means effecting intermittent transport of the first web comprising means causing the first web to alternately travel at a speed $V_v$ for a time interval $T_v$ and then stay at a standstill for a time interval $T_s$, the means moving the toner-applying means back and forth comprising means for moving the toner-applying means in the first web transport direction at a speed $V_1 = V_v \cdot T_v(T_s + T_v)$ when the first web is at a standstill and moving the toner-applying means in the direction opposite to the first web transport direction at a speed $V_2 = V_v \cdot T_s/(T_s + T_v)$ when the first web is in motion.

5. In a copying machine as defined in claim 4, the transport means comprising a transport member engaging the webs and applying transport force thereto, a drive motor, a first clutch coupling the transport member to the drive motor, the means moving the toner-applying means back and forth comprising a second and a third clutch coupling the toner-applying means to the drive motor, and timing means operative for alternately assuming a first state activating the first and second clutches to effect first web transport and travel of the toner-applying means in the direction opposite to the first web transport direction and a second state activating the third clutch to effect travel of the toner-applying means in the first web transport direction when the first web is at a standstill.

6. In a photoelectrophoretic-color-process copying method, in combination, the steps of guiding a first and a second electrode web, of which at least one is transparent, along respective transport paths both of which pass through an exposure station; using a toner applicator located along the first web transport path upstream of the exposure station to apply to the first web a uniform layer of toner suspension; at a location upstream of the exposure station, sandwiching the coated first web and the second web to form a sandwiched film pack in which the toner-suspension layer is confined between the first and second webs; transporting the webs along their respective paths, effecting intermittent transport of at least that section of the webs constituting the sandwiched film pack located at the exposure station, and despite the intermittent transport maintaining the relative movement between the toner applicator and the first web unidirectional and of constant speed; at the exposure station forming a color toner image on a whole-image basis, by projecting the whole image to be copied onto the toner suspension layer of a film pack section through the transparent web thereof while such section is at a standstill at the exposure station, and photoelectrophoretically producing a corresponding color toner image; and downstream of the exposure station transferring the color toner image onto copy material.

* * * * *